US007368687B2

(12) United States Patent
Kagawa

(10) Patent No.: US 7,368,687 B2
(45) Date of Patent: May 6, 2008

(54) HEATING APPARATUS, CONTROL METHOD FOR SAME, AND IMAGE FORMING APPARATUS

(75) Inventor: Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/724,121

(22) Filed: Mar. 13, 2007

(65) Prior Publication Data

US 2007/0170173 A1 Jul. 26, 2007

Related U.S. Application Data

(62) Division of application No. 10/997,381, filed on Nov. 23, 2004.

(30) Foreign Application Priority Data

Nov. 27, 2003 (JP) ..... 2003-397480

(51) Int. Cl.
*H05B 6/14* (2006.01)
*H05B 11/00* (2006.01)

(52) U.S. Cl. ..... 219/619; 219/216

(58) Field of Classification Search ..... 219/619, 219/618, 469, 470, 471, 216; 100/300; *H05B 6/14, H05B 11/00*

See application file for complete search history.

(56) References Cited

U.S. PATENT DOCUMENTS

| | | | | |
|---|---|---|---|---|
| 5,752,150 | A * | 5/1998 | Kato et al. | 399/330 |
| 6,963,056 | B1 * | 11/2005 | Peysakhovich et al. | 219/645 |
| 6,989,516 | B1 * | 1/2006 | Domoto | 219/619 |

FOREIGN PATENT DOCUMENTS

| | | |
|---|---|---|
| JP | 07-114288 | 5/1995 |
| JP | 10-133505 | 5/1998 |
| JP | 11-249491 | 9/1999 |
| JP | 2001-188427 | 7/2001 |
| JP | 2003-229242 | 8/2003 |

* cited by examiner

*Primary Examiner*—Daniel Robinson
(74) *Attorney, Agent, or Firm*—George W. Neuner; David G. Conlin; Edwards Angell Palmer & Dodge LLP

(57) ABSTRACT

Provided are revolving hot roller(s) 31; heating means 33 for heating zonal portion(s) in direction(s) of revolution of hot roller(s) 31; thermistor(s) 35 which is/are temperature detection means for detecting temperature(s) of hot roller(s) 31; and control means 36 for controlling output(s) of heating means 33 based on temperature detection data from thermistor(s) 35; wherein at least one of the control means 36 has timing correction means for correcting timing(s) between temperature detection time(s) of thermistor(s) 35 and heating execution time(s) of heating means 33.

9 Claims, 12 Drawing Sheets

A

B

C

A

B

C

A

B

C

HEATING APPARATUS, CONTROL METHOD FOR SAME, AND IMAGE FORMING APPARATUS

CROSS-REFERENCE TO RELATED APPLICATIONS

This application is a divisional of application Ser. No. 10/997,381, filed Nov. 23, 2004.

BACKGROUND OF INVENTION

This application claims priority under 35 USC 119(a) to Patent Application No. 2003-397480 filed in Japan on 27 Nov. 2003, the content of which is hereby incorporated herein by reference in its entirety.

The present invention relates to a heating apparatus which may be favorably implemented in a fuser apparatus for dry-type electrophotographic equipment, drying apparatus for wet-type electrophotographic equipment, drying apparatus for an inkjet printer, erasing apparatus for rewritable media, and the like; and to a control method for same as well as an image forming apparatus.

Frequently employed as fuser apparatus—this being one type of heating apparatus typically used in copiers, printers, and other such electrophotographic equipment—is a device of a type (the internally heated type) which is ordinarily constructed such that heating means comprising a halogen heater or the like is arranged within a fuser roller made up of a hollow core made of aluminum or the like, the halogen heater being made to generate heat and the fuser roller being set to a prescribed temperature (fusing temperature).

However, with this type of device, there has been the problem that the time following the start of heating until the fuser roller reaches fusing temperature, i.e., the warmup time, is long; and as it will also be necessary from the standpoint of user-friendliness to preheat the fuser roller during standby, electrical power consumption during standby is large.

In order to solve such problems, a fuser apparatus has been proposed (e.g., Japanese Patent Application Publication Kokai No. 2001-188427) of a type (the locally heated type) employing an upper roller (hot roller) having a four-layer structure comprising a core, an elastic layer, and a heat generation layer coated with a thin-film nonstick layer; heating of the upper roller taking place when inductive heating means (inductive heating coil) disposed in the vicinity of the exterior of the upper roller causes direct and local generation of heat by the heat generation layer of the upper roller.

This locally heated type of fuser apparatus has the characteristics listed at (1) and (2), below. (1) Because heat is generated directly by the heat generation layer, this being a thin metal sleeve (thickness on the order of 50μ) comprising Ni, SUS, or the like arranged at the outside circumference of the upper roller (hot roller), and because the nonstick layer on the surface thereof is formed so as to be extremely thin (silicone rubber; thickness on the order of 150μ), the thermal capacity of the upper roller (hot roller) is small, permitting reduction in warmup time.

(2) Because heat is produced at the outside circumferential portion of the upper roller (hot roller), thermal transfer characteristics and thermal supply characteristics relative to recording paper are excellent, as a result of which the need for heating means at the lower roller (pressure roller) is eliminated, simplifying constitution.

However, with the foregoing locally heated type of fuser apparatus, delivery of heat to the hot roller occurs in intensive and local fashion only in the vicinity of a zone in the circumferential direction of the hot roller which is directly below the inductive heating coil, and because the inductive heating coil is disposed adjacent to the hot roller, it would be difficult to arrange a temperature sensor such that it is able to press on the heat-generating portion of the hot roller in the region directly below the inductive heating coil. As a result, there has been the problem that the temperature measurement location of the temperature sensor is offset from the heating location of the inductive heating coil, and that this offset causes instability in temperature control.

Moreover, where the inductive heating coil is arranged so as to be more distant from the surface of the hot roller in order to make it possible for the temperature sensor to press on the heat-generating portion of the hot roller, not only has there been the problem of reduced efficiency in generation of heat by inductive heating, but there have also been problems such as occurrence of noise at the temperature sensor due to the effect of the magnetic field, occurrence of abnormalities during temperature control, and so forth.

SUMMARY OF INVENTION

The present invention was conceived in order to solve such problems as the foregoing in fuser apparatuses of the type in which delivery of heat to hot member(s) occurs locally such as is the case, for example, with fuser apparatuses of the foregoing locally heated type, it being an object thereof to provide a fuser apparatus of the locally heated type that permits stable control without impairment of effectiveness of efforts to reduce warmup time, and to a control method for same.

In order to solve the foregoing and/or other problems, a heating apparatus control method associated with one or more embodiments of the present invention—being a control method for a heating apparatus equipped with one or more revolving hot members, one or more heating means for heating at least one zonal portion in at least one direction of revolution of at least one of the hot member or members, and one or more temperature control means for detecting at least one temperature of at least one of the heating means and for controlling heating by at least one of the heating means based on at least a portion of the temperature data—is such that control by at least one of the temperature control means comprises one or more first steps in which at least one temperature of at least one of the hot member or members is detected; one or more second steps in which heating timing correction data pertaining to heating of at least one of the hot member or members by at least one of the heating means is determined and/or predetermined heating timing correction data is accessed; and one or more third steps in which heating of at least one of the hot member or members by at least one of the heating means is executed based on at least a portion of the temperature detection data and at least a portion of the heating timing correction data.

Because such embodiments of the present invention make it possible, even where temperature detection location(s) is/are offset from heating location(s), to correct for such offset(s) and accurately heat region(s) of hot member(s) requiring heating, it is possible to suppress the phenomenon of divergent thermal ripple arising due to offset(s) between temperature detection location(s) and heating location(s), and it is possible to improve degree(s) of freedom with which temperature detection means can be installed.

In such case, at least a portion of the heating timing correction data may be determined based on information pertaining to at least one positional relationship between at least one heating location of at least one of the heating means and at least one temperature detection location of at least one of the temperature control means; at least one speed of revolution of at least one of the hot member or members; and at least one temperature control delay time of at least one of the temperature control means.

More specifically, control may be such that, taking at least one distance from at least one of the detection location or locations of at least one of the temperature detection means to at least one of the heating location or locations of at least one of the heating means in at least one of the direction or directions of revolution of at least one of the hot member or members to be L [mm]; taking at least one circumferential speed of at least one of the hot member or members to be v [mm/s]; and taking at least one of the temperature control delay time or times of at least one of the temperature control means to be tc [s]; timing of heating by at least one of the heating means is retarded by at least one amount $\Delta t$ [s]; where $\Delta t \cong L/v - tc$.

Here, taking at least one at least one thermal time constant of at least one of the temperature detection means to be $\tau s$ [s]; taking at least one cyclical sampling period of at least one of the temperature detection means and/or at least one cyclical control period of at least one of the temperature control means to be ts [s]; and taking at least one rise time of at least one of the heating means to be th [s]; at least one of the temperature control delay time or times tc [s] of at least one of the temperature control means may satisfy the equation $tc \cong (31.6/v)\cdot(1-e(-\tau s/0.00214v))+0.5ts+th$.

Because use of such heating timing correction data makes it possible to accurately heat region(s) of hot member(s) requiring heating, it is possible to suppress the phenomenon of divergent thermal ripple arising due to offset(s) between temperature detection location(s) and heating location(s), and it is possible to improve degree(s) of freedom with which temperature detection means can be installed. Furthermore, because the optimum amount of correction can be easily found by calculation, it is possible to determine correction data in real-time even in situations such as those in which condition(s) governing correction condition(s) is/are not constant; such as is the case, for example, with an image forming apparatus having a plurality of processing speeds.

Furthermore, at least one of the heating location or locations of at least one of the heating means may be defined to be at least one heat generation subregion upstream in at least one direction of rotation of at least one of the hot member or members from at least one location at which at least one amount of heat generated by at least one of the heating means is initially a maximum. So long as it is heated—even to the smallest degree—by heating means, any arbitrary region may be chosen as heating location of heating means for use in calculating the foregoing correction data. But the location at which the thermal-ripple-reducing effect will be greatest is the aforementioned zone; i.e., the heat generation subregion that is upstream from the location at which the amount of heat generated by the heating means is initially a maximum.

A heating apparatus in accordance with one or more embodiments of the present invention comprises one or more revolving hot members; one or more heating means for heating at least one zonal portion in at least one direction of revolution of at least one of the hot member or members; one or more temperature detection means for detecting at least one temperature of at least one of the hot member or members; and one or more temperature control means for controlling at least one output of at least one of the heating means based on temperature detection data from at least one of the temperature detection means; wherein at least one of the temperature control means has at least one timing correction means for correcting at least one heating execution time of at least one of the heating means based on at least a portion of the temperature detection data and preestablished and/or determined correction data for correcting at least one heating execution time of at least one of the heating means.

Because such embodiments of the present invention make it possible, even where temperature detection location(s) is/are offset from heating location(s), to correct for such offset(s) and accurately heat region(s) of hot member(s) requiring heating, it is possible to suppress the phenomenon of divergent thermal ripple arising due to offset(s) between temperature detection location(s) and heating location(s), and it is possible to improve degree(s) of freedom with which temperature detection means can be installed.

Furthermore, a heating apparatus in accordance with one or more embodiments of the present invention comprises one or more revolving hot members; one or more heating means for heating at least one zonal portion in at least one direction of revolution of at least one of the hot member or members; one or more temperature detection means for detecting at least one temperature of at least one of the hot member or members; and one or more temperature control means for controlling at least one output of at least one of the heating means based on temperature detection data from at least one of the temperature detection means; wherein taking at least one circumferential speed of at least one of the hot member or members to be v [mm/s]; and taking at least one temperature control delay time of at least one of the temperature control means to be tc [s]; at least one of the temperature detection means is installed L [mm] upstream in at least one direction of revolution of at least one of the hot member or members from at least one heating location of at least one of the heating means; where $L \cong v\cdot tc$.

In such case, taking at least one at least one thermal time constant of at least one of the temperature detection means to be $\tau s$ [s]; taking at least one cyclical sampling period of at least one of the temperature detection means and/or at least one cyclical control period of at least one of the temperature control means to be ts [s]; and taking at least one rise time of at least one of the heating means to be th [s]; at least one of the temperature control delay time or times tc [s] of at least one of the temperature control means may satisfy the equation $tc \cong (31.6/v)\cdot(1-e(-\tau s/0.00214v))+0.5ts+th$.

Because installation of temperature detection means at the aforementioned location(s) makes it possible for temperature detection location(s) of temperature detection means on hot member surface(s) to coincide, in terms of timing, with heating location(s) of heating means on hot member surface(s), it is possible to suppress the phenomenon of divergent thermal ripple arising due to offset(s) between temperature detection location(s) and heating location(s).

Furthermore, at least one of the heating location or locations of at least one of the heating means may be defined to be at least one heat generation subregion upstream in at least one direction of rotation of at least one of the hot member or members from at least one location at which at least one amount of heat generated by at least one of the heating means is initially a maximum. So long as it is heated—even to the smallest degree—by heating means, any arbitrary region may be chosen as heating location of heating means for use in the foregoing calculation(s). But the location at which the thermal-ripple-reducing effect will be greatest is the aforementioned zone; i.e., the heat generation subregion that is upstream from the location at which the amount of heat generated by the heating means is initially a maximum.

Furthermore, at least one of the temperature detection means may be disposed within at least one heating region of at least one of the heating means. For example, with a fuser apparatus of an image forming apparatus, when preheating the fuser apparatus during standby, by setting timing correction time(s) and/or the like so as to cause temperature detection means to be located within heating region(s) of heating means, it is possible to carry out preheating without the need to cause rotation of the fuser apparatus during standby, permitting reduction in electrical power consumption during standby.

Moreover, heating means may be inductive heating means. Where heating means is/are inductive heating means, even where characteristic problems thereof such as generation of noise affecting temperature sensor(s) exist, by shifting location(s) of temperature sensor(s) in accordance with the present invention it is possible to overcome such problems in connection with noise.

In such case, inductive heating coil(s) of the inductive heating means may be disposed at exterior(s) of hot member(s). If inductive heating means is/are disposed at interior(s) of hot member(s), inductive heating means will not constitute physical obstacle(s) with respect to attachment of temperature sensor(s); if inductive heating means is/are disposed at exterior(s) of hot member(s), this will constitute physical obstacle(s). The present invention may be more utilized to greater benefit in the latter case.

Furthermore, an image forming apparatus in accordance with one or more embodiments of the present invention is equipped with heating apparatus(es) having any of the foregoing respective constitution(s). Fuser apparatus(es) employed in such image forming apparatus(es) make it possible, through use of local heating means utilizing inductive heating and/or the like, to shorten warmup time(s) and improve energy conservation characteristics.

Because heating apparatus control method(s) associated with one or more embodiments of the present invention make it possible, even where temperature detection location(s) is/are offset from heating location(s), to correct for such offset(s) and accurately heat region(s) of hot member(s) requiring heating, it is possible to suppress the phenomenon of divergent thermal ripple arising due to offset(s) between temperature detection location(s) and heating location(s), and it is possible to improve degree(s) of freedom with which temperature detection means can be installed.

DESCRIPTION OF PREFERRED EMBODIMENTS

Below, embodiments of the present invention are described with reference to the drawings.

In the present embodiment, the heating apparatus of the present invention is described in terms of an example in which it is applied to a fuser apparatus in color electrophotographic equipment.

Figure 1:
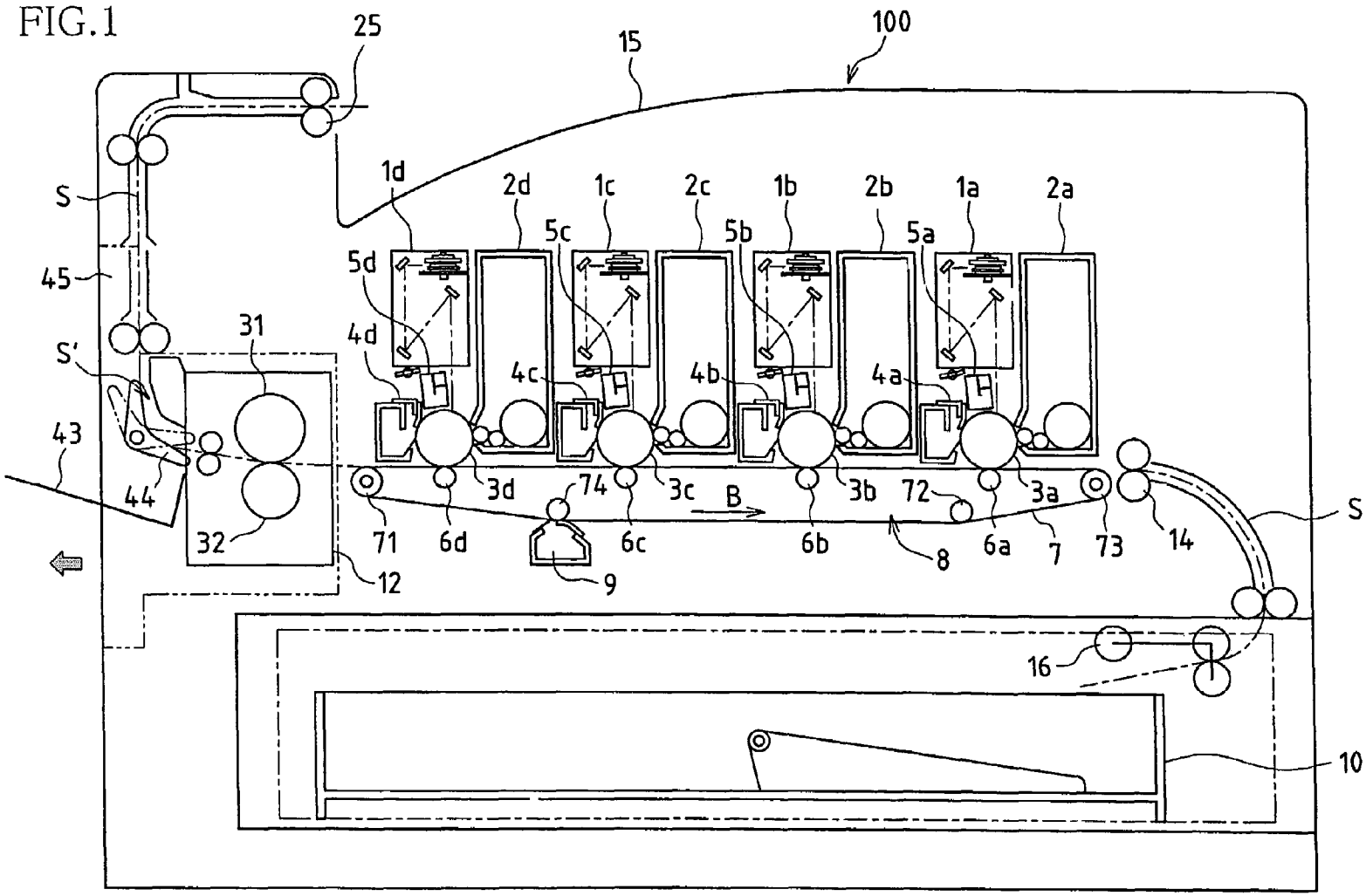
FIG. 1 is a schematic sectional diagram of an image forming apparatus employing a fuser apparatus utilizing a heating apparatus in accordance with one or more embodiments of the present invention.

FIG. 1 is a schematic sectional diagram showing an example of system constitution at image forming apparatus 100 utilizing an electrophotographic process and employing a fuser apparatus utilizing a heating apparatus in accordance with the present embodiment.

The present image forming apparatus 100, which forms multicolor and/or monochrome images on prescribed media (recording paper) in correspondence to image data transmitted thereto from the exterior, comprises exposing unit(s) 1; developer(s) 2; photosensitive drum(s) 3; charging unit(s) 5; cleaning unit(s) 4; transfer/transport belt unit(s) 8, fuser unit(s) (fuser apparatus(es)) 12; paper transport path(s) S; media supply tray(s) 10; discharge tray(s) 15, 43; and so forth.

Moreover, image data handled by the present image forming apparatus 100 corresponds to color images utilizing the respective colors black (K), cyan (C), magenta (M), and yellow (Y). Accordingly, there are four each of exposing unit 1 (1*a*, 1*b*, 1*c*, 1*d*), developer 2 (2*a*, 2*b*, 2*c*, 2*d*), photosensitive drum 3 (3*a*, 3*b*, 3*c*, 3*d*), charging unit 5 (5*a*, 5*b*, 5*c*, 5*d*), cleaning unit 4 (4*a*, 4*b*, 4*c*, 4*d*) provided so as to respectively form four latent images in correspondence to the respective colors and constituting four imaging stations, with the letter "a" being appended to reference numerals for black components, the letter "b" being appended to reference numerals for cyan components, the letter "c" being appended to reference numerals for magenta components, and the letter "d" being appended to reference numerals for yellow components.

Photosensitive drum 3 is arranged (loaded) roughly centrally in the present image forming apparatus 100.

Charging unit 5 is charging means for causing the surface of photosensitive drum 3 to be uniformly charged to prescribed electric potential(s); besides contact-type roller-type and brush-type charging units, scorotron-type charging units may, as indicated in the drawing, be employed as same.

Exposing unit 1 may, for example, employ write head(s) of EL, LED, or similar type in which light-emitting elements are arranged in array-like fashion; a laser scanning unit (LSU) equipped with a laser-irradiating subassembly and reflecting mirror(s); or the like. Moreover, by exposing charged photosensitive drum 3 in correspondence to image data input thereto, exposing unit 1 has the ability to cause formation of an latent electrostatic image on the surface of photosensitive drum 3 in correspondence to image data.

Developer 2 uses toner (K, C, M, or Y; depending on the color of the station in question) to cause the latent electrostatic image formed on photosensitive drum 3 to become manifest.

Cleaning unit 4 removes/recovers toner residue from the surface of photosensitive drum 3 following develop and image transfer.

Transfer/transport belt unit 8, arranged below photosensitive drum 3, comprises transfer belt(s) 7, transfer belt drive roller(s) 71, transfer belt tension roller(s) 72, transfer belt idler roller(s) 73, transfer belt support roller(s) 74, transfer roller(s) 6 (6*a*, 6*b*, 6*c*, 6*d*), and transfer belt cleaning unit(s) 9.

Transfer belt drive roller 71, transfer belt tension roller 72, transfer roller 6, transfer belt idler roller 73, transfer belt support roller 74, and so forth suspend and impart tension to transfer belt 7 and drive transfer belt 7 in rotational fashion in the direction indicated by arrow B.

Transfer roller 6 is rotatably supported by a frame (not shown) at the interior of the transfer belt unit and transfers the toner image from photosensitive drum 3 to media (recording paper) clinging to transfer belt 7 while being transported thereby.

Transfer belt 7 is provided in such fashion that it comes in contact with respective photosensitive drums 3. Moreover, transfer belt 7 has the ability to form color toner image(s) (multicolor toner image(s)) by sequentially transferring toner images of respective colors which are formed on photosensitive drums 3 to media (recording paper) in superposed fashion. This transfer belt is formed in endless fashion using film of thickness on the order of 100μ.

Transfer of the toner image from photosensitive drum 3 to media (recording paper) is carried out by transfer roller 6, which comes in contact with the back of transfer belt 7. To cause transfer of the toner image, a high voltage (high voltage of opposite polarity (+) as charge polarity (−) of toner) is applied to transfer roller 6.

The transfer roller is a roller in which an electrically conductive elastic material (e.g., EPDM, urethane foam, etc.) covers the surface of a base material in the form of a metal (e.g., stainless steel) shaft of diameter 8 to 10 mm. This electrically conductive elastic material is capable of uniformly applying a high voltage to recording paper (media). Whereas transfer roller 6 is employed as transfer electrode in the present embodiment, brush(es) may alternatively or additionally be employed as same.

Furthermore, because contact with photosensitive drum 3 can cause toner adhering to transfer belt 7 to soil back(s) of recording paper, transfer belt cleaning unit 9 is arranged so as to remove/recover same. Transfer belt cleaning unit 9 is, for example, equipped with a cleaning blade serving as cleaning member which comes in contact with transfer belt 7; transfer belt 7 being supported from the back thereof by transfer belt support roller 74 at the approximate location at which the cleaning blade comes in contact with transfer belt 7.

Media supply tray 10, being a tray for storage of media (recording paper) used for image formation, is provided below the image forming unit of the present image forming apparatus 100. Furthermore, discharge tray 15 provided at the upper portion of the present image forming apparatus 100 is a tray for accepting face-down placement of media on which printing has been completed, and discharge tray 43 provided at the side portion of the present image forming apparatus 100 is a tray for accepting face-up placement of media on which image formation has been completed.

Furthermore, the present image forming apparatus 100 is provided with s-shaped paper transport path S for delivering media from media supply tray 10 to discharge tray 15 by way of transfer/transport belt unit 8 and fuser unit 12. Moreover, arranged in the vicinity of paper transport path S which extends from media supply tray(s) 10 to discharge tray(s) 15 and/or discharge tray(s) 43 are takeup roller(s) 16, registration roller(s) 14, fuser unit(s) 12, transport-direction-switching gate(s) 44, media-transporting transport roller(s) 25, and so forth.

Transport rollers 25 are small rollers for promoting/assisting transport of media, a plurality thereof being provided along paper transport path S. Takeup roller(s) 16 is/are provided at one end of media supply tray 10, being takeup roller(s) for supplying media one sheet at a time to paper transport path S from media supply tray 10.

Transport-direction-switching gate 44 is rotatably provided at side cover 45, and when moved from the configuration drawn in solid line to the configuration drawn in broken line, permits media to be diverted at a point midway along paper transport path S so as to be discharged into discharge tray 43. When in the configuration drawn in broken line, media travels along paper transport path S'—this constituting a portion of paper transport path S and being formed between transport-direction-switching gate 44 and fuser unit 12 and side cover 45—and is discharged into upper discharge tray 15.

Furthermore, registration rollers 14 temporarily retain media being transported along paper transport path S. Moreover, registration rollers 14 have the ability to transport media in well-timed fashion with respect to rotation of photosensitive drums 3 so as to permit toner images on photosensitive drums 3 to be satisfactorily transferred onto media in superposed fashion.

That is, registration rollers 14 are arranged so as to transport media based on detection signal(s) output from preregistration detection switch(es), not shown, so as to cause lead edges of toner images on respective photosensitive drums 3 to match the lead edge of the imaging area on the media.

Fuser unit 12 is equipped with fuser (hot) roller(s) 31, pressure roller(s) 32, and so forth; hot roller 31 and pressure roller 32 rotating as media is held in the nip formed therebetween.

Furthermore, fuser (hot) roller 31 is set so as to be at prescribed fusing temperature(s) by controller(s), not shown, based on detected temperature value(s); and has the ability by acting in thermocompressive fashion on media present within the compressed region (nip) formed between the two rollers to cause the multicolor toner image transferred to the media to be melted, fused, and compressed, thermocompressively bonding it to the media.

Moreover, following fusing of the multicolor toner image thereonto, media is transported by transport rollers 25, . . . along the flipping discharge route of paper transport path S so as to cause the media to be discharged into discharge tray 15 in a flipped state (i.e., such that the multicolor toner image faces down).

Note that while description here has been carried out in terms of a multicolor image forming apparatus, it is alternatively possible for the apparatus to be equipped with an image forming station for a single color.

FIRST WORKING EXAMPLE

Next, a fuser apparatus utilizing a heating apparatus associated with a first working example of the present invention will be described in detail.

Figure 2:
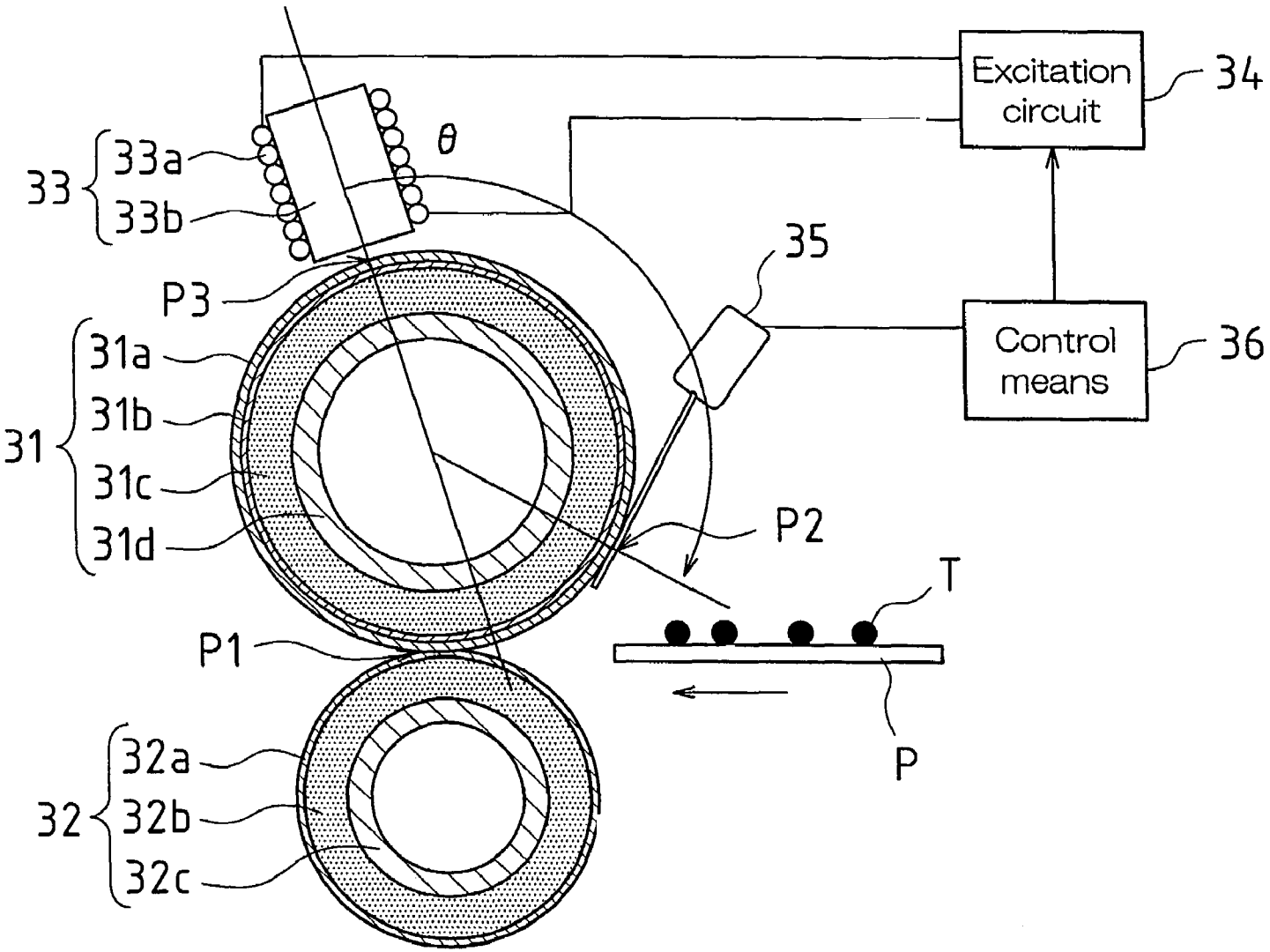
FIG. 2 is a schematic diagram of a fuser apparatus utilizing a heating apparatus associated with a first working example of the present invention.

FIG. 2 is a schematic diagram of a fuser apparatus utilizing a heating apparatus associated with the present first working example.

This fuser apparatus is such that hot roller (hot member) 31, which has a metal sleeve constituting a heat generation layer, is heated by inductive heating means 33, which is arranged at the exterior thereof; and by feeding recording paper (material to be heated) P, which has unfused toner image T thereon, through compressed region (nip) P1 between pressure roller 32 and said hot roller 31 which has been heated to constant temperature, this fuser apparatus causes the image to be fused on recording paper.

Hot roller 31 is 40 mm in diameter and is constructed such that sequentially formed over core 31*d* comprising aluminum, iron, stainless steel, or other such metal (but note that aluminum is desired so as to prevent generation of heat by inductive heating) there are elastic layer 31*c* comprising foamed silicone rubber and heat generation layer 31*b* comprising a metal sleeve.

Metal sleeve 31*b* is a heat-generating body that generates heat as a result of inductive heating action, the thickness thereof being kept small, at 40μ to 50μ, so as to reduce surface temperature rise time.

In order to carry out heating by inductive heating, the material for metal sleeve 31*b* may be iron, SUS 430 stainless steel, or the like; it being sufficient that it be an electrically conductive material displaying magnetism. Materials having high relative magnetic permeability are particularly suitable, it being possible to use silicon steel or magnetic steel, nickel steel, and the like. Furthermore, even nonmagnetic substances may be used, since inductive heating will be possible with SUS 304 stainless steel and other such materials so long as resistance thereof is high. Moreover, even nonmagnetic-based materials (e.g., ceramic, etc.) may also be used so long as this is done in the context of a configuration in which material such as the aforementioned having high relative magnetic permeability is/are arranged therein in such fashion as to impart electrical connectivity thereto.

Here, as metal sleeve 31*b*, a 40μ thickness of nickel fabricated by electroforming is used. Furthermore, metal sleeve 31*b* may be constituted from a sleeve comprising a plurality of layers in order to increase the amount of heat which is generated.

Furthermore, to prevent toner which has been reduced in viscosity as a result of being heated by nip P1 from sticking to hot roller 31, the surface (outside circumferential surface) of the metal sleeve is coated with nonstick layer 31*a* made up of PTFE (polytetrafluoroethylene), PFA (tetrafluoroethylene-perfluoroalkylvinylether copolymer), or other such fluorocarbon resin; silicone rubber, fluorocarbon rubber, fluorosilicone rubber, or other such elastic substances; or laminates of a plurality thereof.

It is preferred especially for color applications that rubber-type material having elasticity be employed at nonstick layer 31*a*; in the present first working example, nonstick layer 31*a* is constituted such that a PFA tube of wall thickness 30μ is laminated over a silicone rubber (LTV) layer of thickness 150μ.

Metal sleeve 31*b* being extremely thin as described above, it alone would not be capable of providing sufficient mechanical strength. Hot roller 31 of the present first working example is therefore provided with elastic layer 31*c* to the inside of metal sleeve 31*b*, in order to secure and support metal sleeve 31*b*. In order to withstand the temperature of metal sleeve 31*b* while simultaneously greatly preventing escape of heat from metal sleeve 31*b*, foamed silicone rubber, which has excellent thermal insulation and heat-resistant properties, may be used as elastic layer 31*c*; and a thickness of, e.g., 6 mm may be used for same.

As shown in FIG. 2, inductive heating means 33, which heats hot roller 31, is made up of magnetic core 33*b* and inductive coil 33*a* which is wrapped around the outside circumference thereof; inductive heating means 33 being arranged so as to oppose the outside circumferential portion of hot roller 31.

Magnetic core 33*b* is a core having rectangular cross-section and high magnetic permeability; ferrite, permalloy, or other such materials used as transformer cores may be used for same (ferrite which has low losses at high frequencies is more preferred).

As material for inductive coil 33*a*, while solid aluminum wire (having an insulating surface layer; e.g., oxide film) is used here due to heat resistance considerations, it is also possible to use copper wire or wire made from copper-based composite material, or litz wire (stranded wire in which the strands are made up of enameled wire or the like). Regardless of which wire material is used, to suppress joule losses due to the coil, total resistance of the inductive coil should be not more than 0.5Ω, and preferably not more than 0.1Ω. Furthermore, a plurality of inductive coils 33*a* may be arranged in correspondence to sizes of recording paper to be subjected to fusing.

The alternating magnetic field produced when excitation circuit 34 shown in FIG. 2 causes high-frequency current to flow in this inductive coil 33*a* causes inductive heating of hot roller 31. Disposed in the vicinity of the exit side of the nip is thermistor 35 for detecting surface temperature of hot roller 31, control means (temperature control means) 36 made up of a CPU (central processing unit) or the like controlling excitation circuit 34 in correspondence to a detection signal from thermistor 35, as a result of which the temperature of hot roller 31 is controlled so as to be constant.

Pressure roller 32, which comes in contact with hot roller 31 and which is for forming nip P1 for feeding recording paper P therethrough, is 30 mm in diameter and is constructed such that present over iron, stainless-steel, or aluminum core 32*c* is silicone rubber or other such elastic layer 32*b*; and furthermore such that formed on the surface of the elastic layer there is nonstick layer 32*a* for preventing toner and/or paper dust from sticking thereto.

Possible materials for nonstick layer 32*a* of the pressure roller include, for example, PFA, PTFE, or other such fluorocarbon resin materials; and silicone rubber, fluorocarbon rubber, fluorosilicone rubber, or other such rubber materials; but in the present first working example, an electrically nonconductive PFA tube of thickness 50μ is used as nonstick layer.

Pressure roller 32 abuts hot roller 31 with prescribed pressure (280 N in the present working example) due to action of an elastic member (spring), not shown; as a result of which, contact nip P1 of width on the order of 7 mm is formed between pressure roller 32 and hot roller 31.

During fusing operations employing a fuser apparatus constituted as described above, hot roller 31 is rotated by drive means and heating is carried out by inductive heating means 33, increasing the temperature of the surface of hot roller 31 to a constant temperature (170° C. in the present working example). After the surface of hot roller 31 has reached constant temperature, recording paper P, having unfused toner image T thereon, is fed through nip P1, heat and pressure causing this toner image T to be fused onto recording paper P. When feeding of recording paper P therethrough is completed, heating by inductive heating means 33 is stopped, completing fusing operations.

Next, referring to FIGS. 2 through 10, a temperature control method for a fuser apparatus utilizing a heating apparatus associated with the present first working example will be described in detail.

As shown in FIG. 2, the fuser apparatus of the present first working example is such that point P2 (temperature detection location) at which temperature sensor 35 comprising a thermistor presses against hot roller 31 is set so as to be shifted in the circumferential direction of hot roller 31 by angle θ [°] from heating location P3 of inductive heating means 33. Hereinafter, the location at which temperature sensor 35 presses thereagainst will be expressed as the angle θ [°] from this heating location P3, positive (+) angles indicating displacement downstream, and negative (−) angles indicating displacement upstream, relative to the direction of rotation of hot roller 31.

It was learned as a result of experimental study that temperature control becomes unstable (hot roller temperature diverges) depending upon the way in which this angle θ [°] is set, and so a two-dimensional thermal conduction simulation utilizing the finite difference method was used in an attempt to analyze this phenomenon.

In an ordinary thermal conduction simulation, calculations are carried out with no consideration being made for the effect of the delay time due to the temperature control means (in other words, delay time is assumed to be zero); but in the present analysis, ability to allow for this delay time due to temperature control means was incorporated into the simulator.

More specifically, taking the control delay time of the temperature control means to be tc [s], the factors producing tc comprise the three factors listed below, and this can be expressed as Formula (1).

$$Tc=t1+t2+t3 \quad (1)$$

where t1=control delay time due to temperature sensor; t2=control delay time due to control system; t3=heating delay time due to heating means Here, the temperature detection delay time t1 at the temperature sensor can be calculated based on the thermal time constant τs of the temperature sensor by using Formula (2), below.

$$Ts(t+\Delta t)=Ts(t)+(Tr(t+\Delta t)-Tr(t))\cdot(1-\epsilon(-\Delta t/\tau s)) \quad (2)$$

where Ts(t)=temperature [° C.] detected by temperature sensor at time t; Tr(t)=hot roller temperature [° C.] at temperature sensor detection location at time t; Δt=time [s] used for calculation of 1 step in two-dimensional thermal conduction simulation; τs=thermal time constant [s] of temperature sensor Furthermore, the control delay time t2 due to the control system is determined by the temperature detection sampling period or control period for 1 cycle ts.

Moreover, the heating delay time t3 due to the heating means is determined by the time th that it takes for the heating means to generate a prescribed amount of thermal energy (the rise time of the heating means).

By establishing these three parameters, the present simulation was therefore able to take into consideration the effect of delay time due to temperature control.

Figure 3:
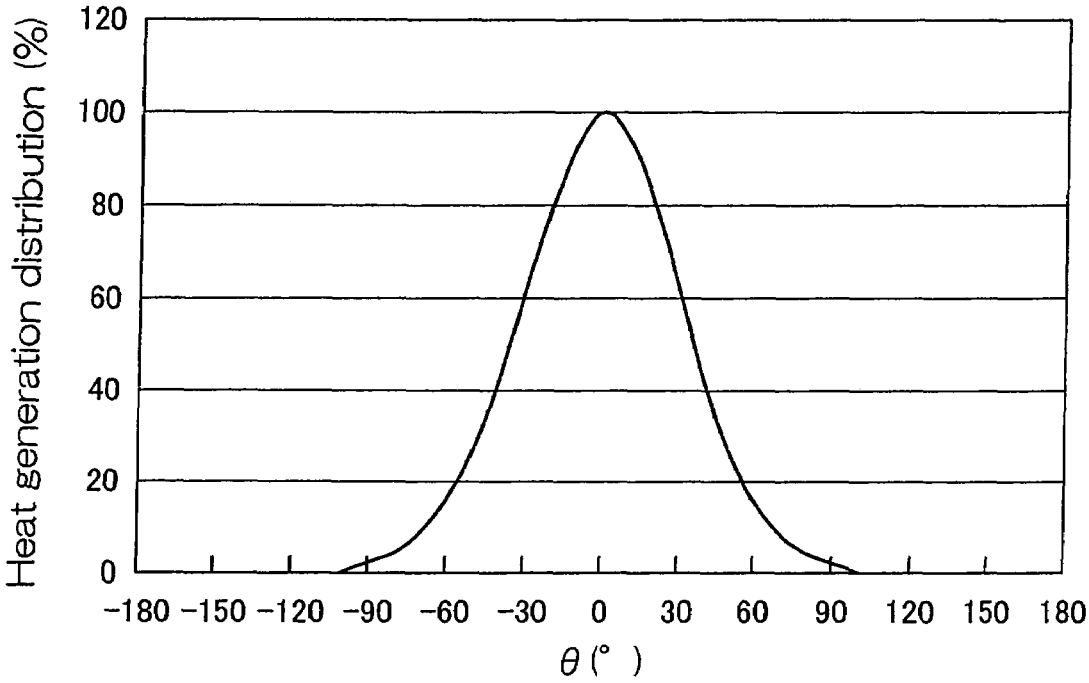
FIG. 3 is a graph showing heat generation distribution of the heating means in the circumferential direction in a fuser apparatus utilizing a heating apparatus associated with the first working example of the present invention.
Figure 4:
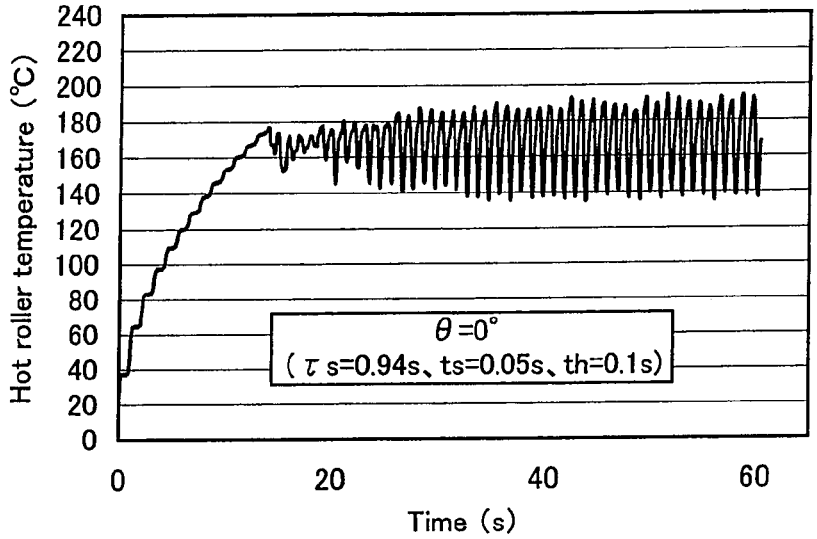
FIGS. 4A, B, C are graphs showing change in hot roller temperature in a fuser apparatus of the externally inductively heated type when 20 sheets are continuously fed therethrough following completion of warmup.
Figure 4:
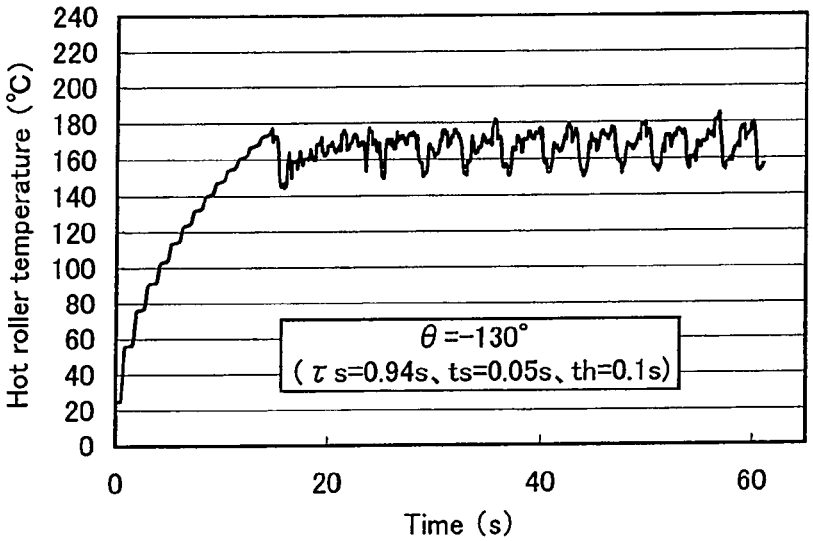
Figure 4:
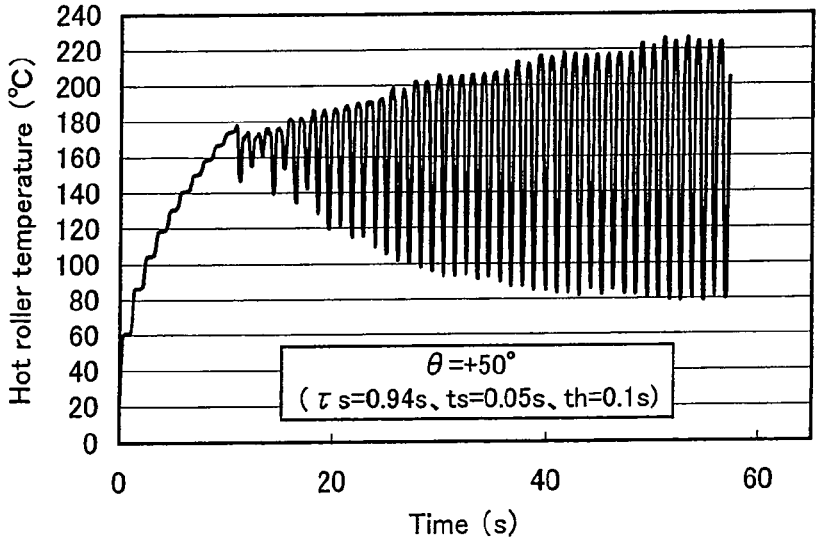

Furthermore, it was learned as a result of separate analysis of the magnetic field and experimental verification that heat generation distribution characteristics of inductive coil 33*a* in the circumferential direction of hot roller 31 were as indicated at FIG. 3, and so these heat generation distribution characteristics were used to carry out simulation(s).

FIGS. 4A through C indicate results when the foregoing simulation is used to calculate hot roller temperature when 20 sheets of recording paper are continuously fed through a fuser apparatus following warmup thereof.

From these, it can be seen that while hot roller temperature diverges when θ is 0° or +50°; temperature control stabilizes when θ is −130°, with thermal ripple being under control at not more than 30° C. Note that these computational results have been separately confirmed to agree with experimental results.

The relationship between the location θ at which temperature sensor 35 presses against hot roller 31 and thermal ripple was then determined by simulation. Results are shown in FIG. 5.

Figure 5:
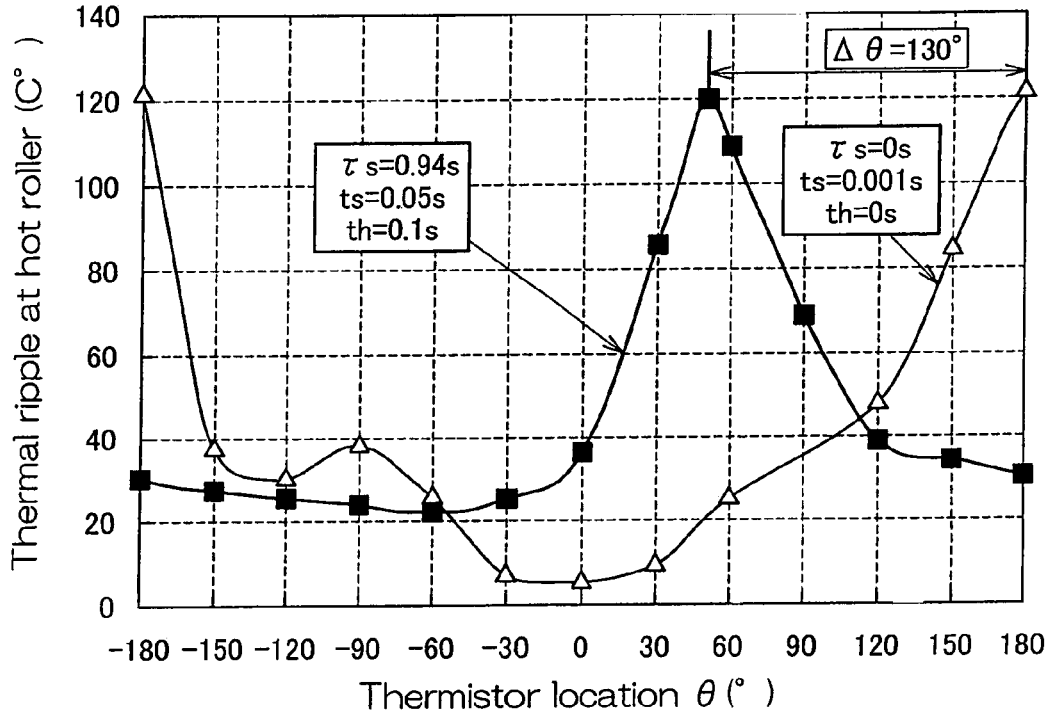
FIG. 5 is a graph showing relationship between temperature sensor location and thermal ripple at the hot roller in a fuser apparatus of the externally inductively heated type.

From FIG. 5, it is clear that by varying θ it is possible to find a location at which thermal ripple is a maximum. Furthermore, it is clear that the location at which θ is a maximum varies depending upon such parameters as the thermal time constant τs of the temperature sensor, the sampling period ts, and the rise time th of the heating means.

From FIG. 5, when all of the parameters contributing to control delay are set to 0, i.e., τs=0, ts≅0 (=0.0001) and th=0, this can be thought of as corresponding to an ideal situation in which there is absolutely no delay with respect to control of temperature. In such case, the reason for the maximum at θ=180° (−180°) can be understood to be because heating location P3 and the temperature detection location are directly opposite each other.

On the other hand, with respect to the conditions at which the present first working example was carried out—these being τs=0.94, ts=0.05, and th=0.1—it is clear that there is a maximum at θ=50°, meaning that the maximum occurs at a location which is shifted upstream by Δθ=130° from the ideal situation.

This is thought to be due to the fact that, while temperature sensor 35 is installed at the location θ=50°, the delay in temperature control introduces a delay which when converted to an equivalent angle corresponds to delay in the amount Δθ=130° that intervenes before heating can actually be executed by the heating means.

Figure 7:
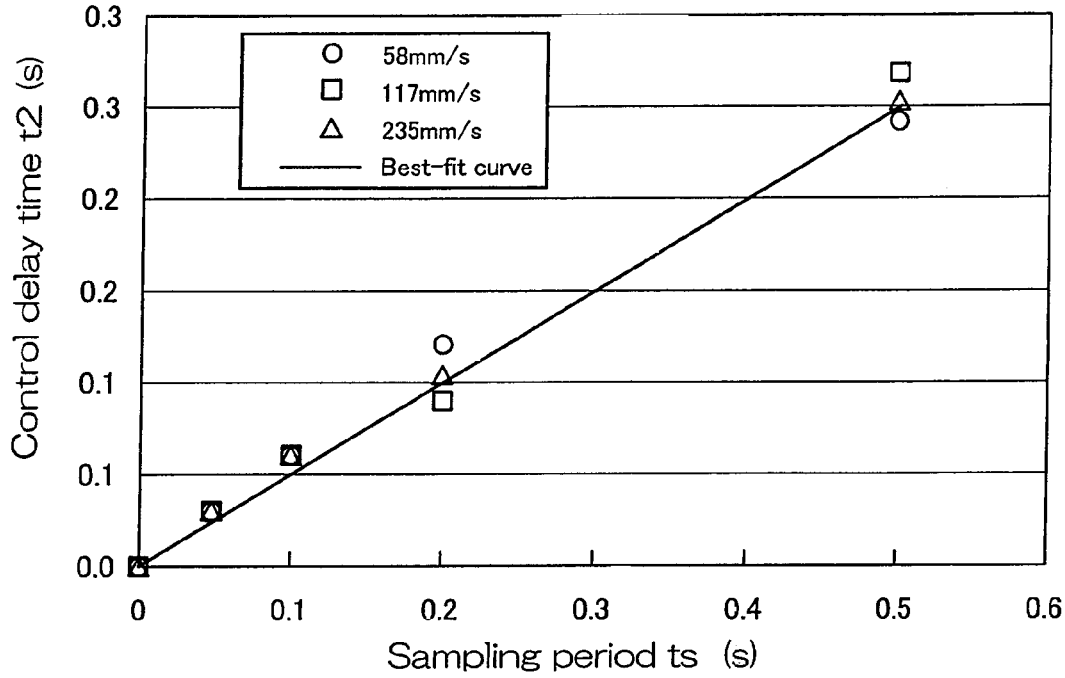
FIG. 7 is a graph showing relationship between cyclical sampling period and temperature control delay time.
Figure 8:
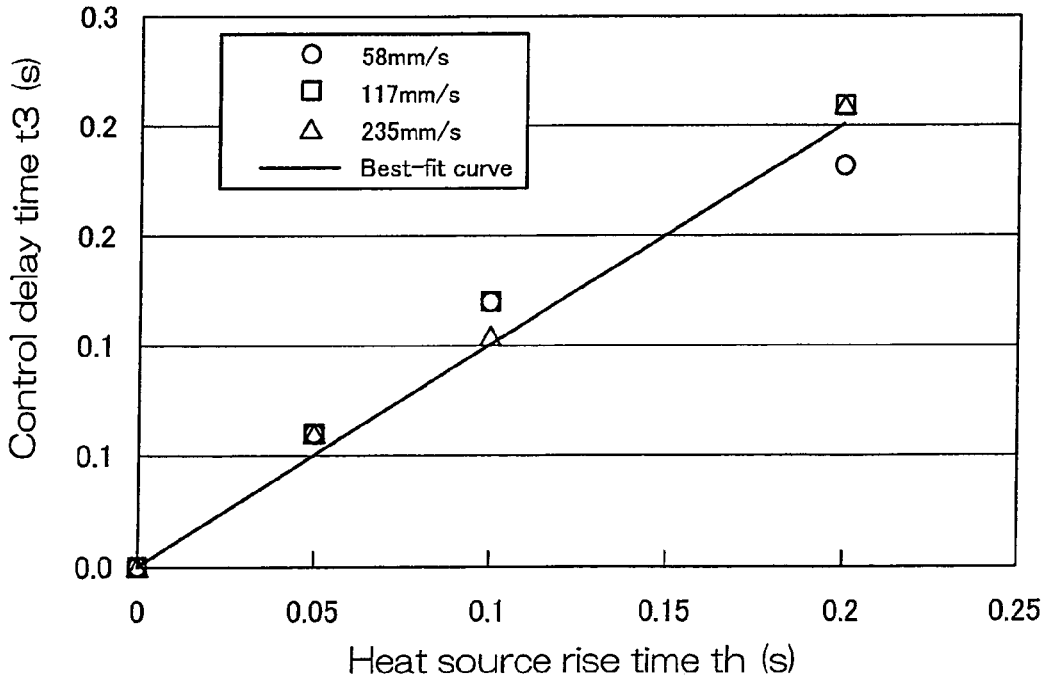
FIG. 8 is a graph showing relationship between heat source rise time and temperature control delay time.

Furthermore, Formula (3), below, may be used to convert this delay angle Δθ [°] into a delay time tc [s].

$$tc=\pi\cdot Dh\cdot\Delta\theta/360v \quad (3)$$

where Dh=diameter of hot roller [mm]; v=circumferential speed of hot roller [mm/s] Based on the foregoing results, by varying any one of the aforementioned three parameters and using values corresponding to the ideal situation in which there is no delay for the other parameters, i.e., holding the other parameters constant at zero, it is possible by calculating maxima to determine the relationships between the respective parameters and control delay time. Results of calculation are shown in FIGS. 6 through 8.

Figure 6:
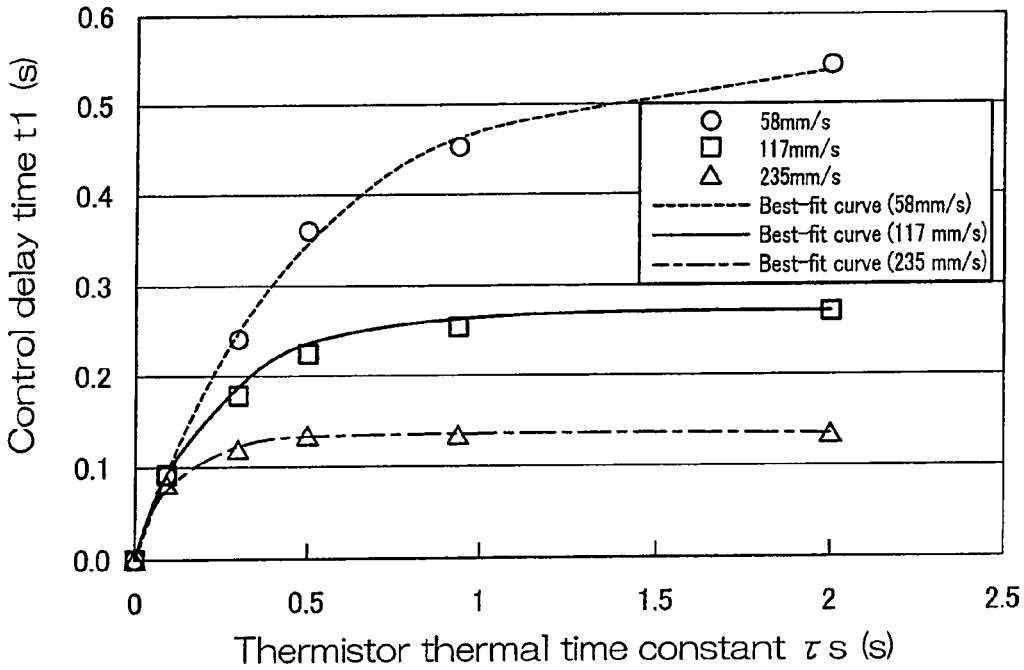
FIG. 6 is a graph showing relationship between thermistor thermal time constant and temperature control delay time.

FIG. 6 indicates results of calculation of the relationship between temperature sensor thermal time constant τs and control delay time t1 for three hot roller circumferential speeds (58 mm/s, 117 mm/s, and 235 mm/s).

From these results, it was learned that, regardless of hot roller to circumferential speed v, it is possible to approximate control delay time t1 arising due to the temperature sensor using the approximation shown at Formula (4), below.

$$t1 \cong (31.6/v)\cdot(1-e(-\tau s/0.00214v)) \quad (4)$$

Similarly, FIG. 7 indicates results of calculation of the relationship between temperature detection sampling period (control period for 1 cycle) ts and control delay time t2 for three hot roller circumferential speeds (58 mm/s, 117 mm/s, and 235 mm/s).

From these results, it was learned that, regardless of hot roller to circumferential speed v, it is possible to approximate control delay time t2 arising due to the temperature detection sampling period using the approximation shown at Formula (5), below.

$$t2 \cong 0.5ts \quad (5)$$

Moreover, FIG. 8 indicates results of calculation of the relationship between heating means rise time th and control delay time t3 for three hot roller circumferential speeds (58 mm/s, 117 mm/s, and 235 mm/s).

From these results, it was learned that, regardless of hot roller to circumferential speed v, it is possible to approximate control delay time t3 arising due to the heating means rise time using the approximation shown at Formula (6), below.

$$t3 = th \quad (6)$$

Based on Formulas (1), (4), (5), and (6), above, it is possible to express control delay time tc [s] due to the temperature control means as indicated at Formula (7), below.

$$tc = (31.6/v)\cdot(1-e(-\tau s/0.00214v)) + 0.5ts + th \quad (7)$$

By using this Formula (7) to set installation location P2 of temperature sensor 35 so that it is upstream by an amount L [mm] as calculated using Formula (8), below, in the direction of revolution of the hot roller from heating location P3 of the heating means, because temperature detection location P2 of temperature sensor 35 on the hot roller surface can be made to coincide, in terms of timing, with heating location P3 of the heating means on the hot roller surface, it is possible to suppress the phenomenon of divergent thermal ripple arising due to offset between the temperature detection location and the heating location.

$$L = v\cdot tc \quad (8)$$

where v [mm/s]=hot roller circumferential speed

Depending on the layout of the fuser apparatus, there may be situations in which it is just impossible to install the temperature sensor at location L.

For example, this would be the case where the location of L happens to coincide with fusing nip P1. In such a situation, by retarding the timing of heating by the heating means by a time Δt [s] as given by Formula (9), because temperature detection location P2 of temperature sensor 35 on the hot roller surface can be made to coincide, in terms of timing, with heating location P3 of the heating means on the hot roller surface, and regions of the hot roller surface requiring heating can be accurately heated, it is possible to suppress the phenomenon of divergent thermal ripple arising due to offset between the temperature detection location and the heating location, and it is possible to improve the degree(s) of freedom with which the temperature sensor can be installed.

$$\Delta t = L/v - tc \quad (9)$$

Furthermore, by switching Δt, it is possible to accommodate situations such as those in which the condition(s) governing Δt is/are not constant; such as is the case, for example, with an image forming apparatus having a plurality of processing speeds.

Figure 9:
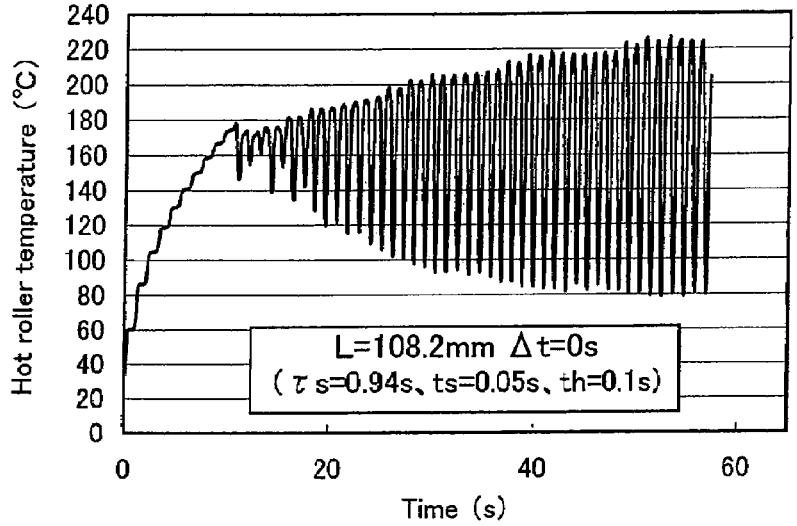
FIGS. 9A, B, C are graphs comparing thermal ripple in a fuser apparatus utilizing a heating apparatus associated with the first working example to a conventional example.
Figure 9:
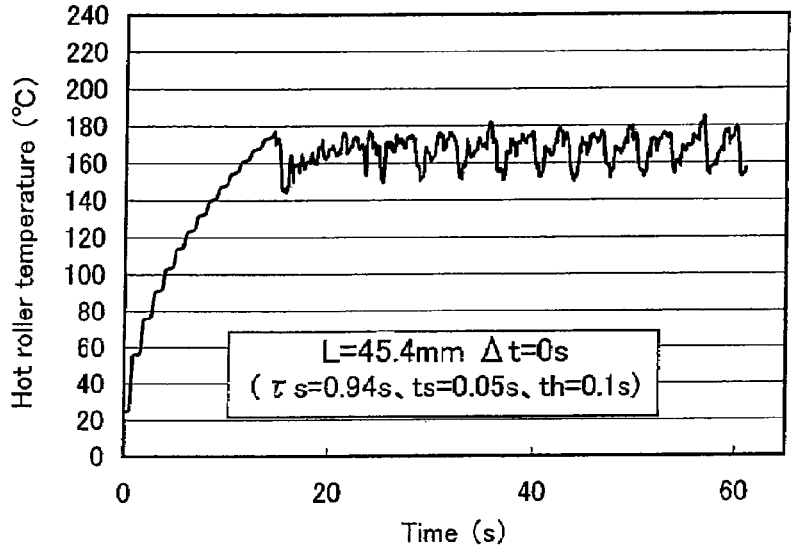
Figure 9:
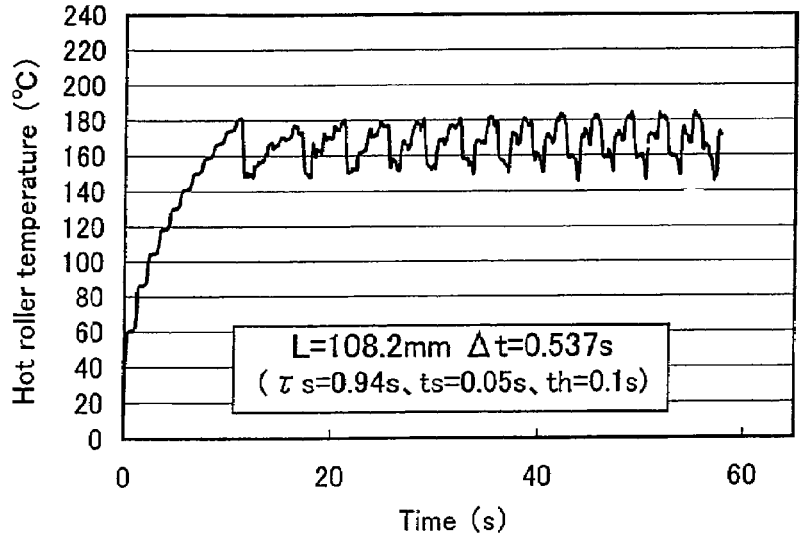

FIG. 9 shows results of using two-dimensional thermal conduction simulation to verify thermal-ripple-reducing effect at hot roller 31 for embodiments respectively corresponding to claim 7 and claim 3 of the present application (i.e., (1) locating the temperature sensor at L=v·tc; (2) retarding heating timing by Δt≅L/v−tc).

In the present first working example, because v=117 mm/s, τs=0.94 s, ts=0.05 s, and th=0.1 s, Formula (7) gives:

$$tc = 0.388 \text{ [s]}$$

Formula (8) can therefore be used to obtain:

$$L = 117 \times 0.388 = 45.4 \text{ [mm]}$$

Accordingly, to use the location of the temperature sensor to stabilize temperature control, the temperature sensor should be installed at L=45.4 mm.

Furthermore, if the temperature sensor is installed at location L=108.2 mm, because Formula (9) gives $$\Delta t = 108.2/117 - 0.388 = 0.537 \text{ [s]},$$

control timing should be offset by an amount Δt=0.537 second.

FIG. 9A indicates the situation when temperature sensor location L=108.2 mm and Δt=0 (i.e., there is no correction of control timing; hereinafter "Comparative Example"); FIG. 9B indicates optimal temperature sensor location (L=45.4 mm; hereinafter "Preferred Working Example (1)"); and FIG. 9C indicates the situation when correction of control timing is carried out (L=108.2 mm and Δt=0.537 s; hereinafter "Preferred Working Example (2)")—results in all cases being calculated for hot roller temperature when 20 sheets of recording paper are continuously fed through a fuser apparatus following warmup thereof.

From these computational results, it can be seen that while hot roller temperature diverges in the Comparative Example; temperature control stabilizes in Preferred Working Examples (1) and (2) in which temperature sensor location and control timing are optimized, with thermal ripple being under control at not more than 30 C.° Note that these computational results have been separately confirmed to agree with experimental results.

Studies were then carried out with respect to where the optimal location should be for heating location P3 of inductive heating means 33 in the aforementioned Preferred Working Examples (1) and (2).

Heating location P3 of inductive heating means 33 was in studies performed up to this point tentatively defined to be the location at which the amount of heat generated by inductive heating means 33 peaked as shown in FIG. 3, with studies being carried out so as to cause correction of timing or correction of the location of temperature sensor 35 to produce agreement relative to this peak location; but because, as shown in FIG. 3, the distribution of heat generated by inductive heating means 33 has a finite width (heat generation region), it is necessary to study which location within the heat generation region would most optimally be defined as heating location P3 when carrying out correction of timing and correction of location of temperature sensor 35.

By using two-dimensional thermal conduction simulation to calculate thermal ripple while varying timing correction time Δt with the location of temperature sensor 35 held constant at −180° from the location of the heat generation peak of inductive heating means 33, studies were therefore carried out to see which location within the heating region is best used in determining timing correction. Results are shown in FIG. 10.

Figure 10:
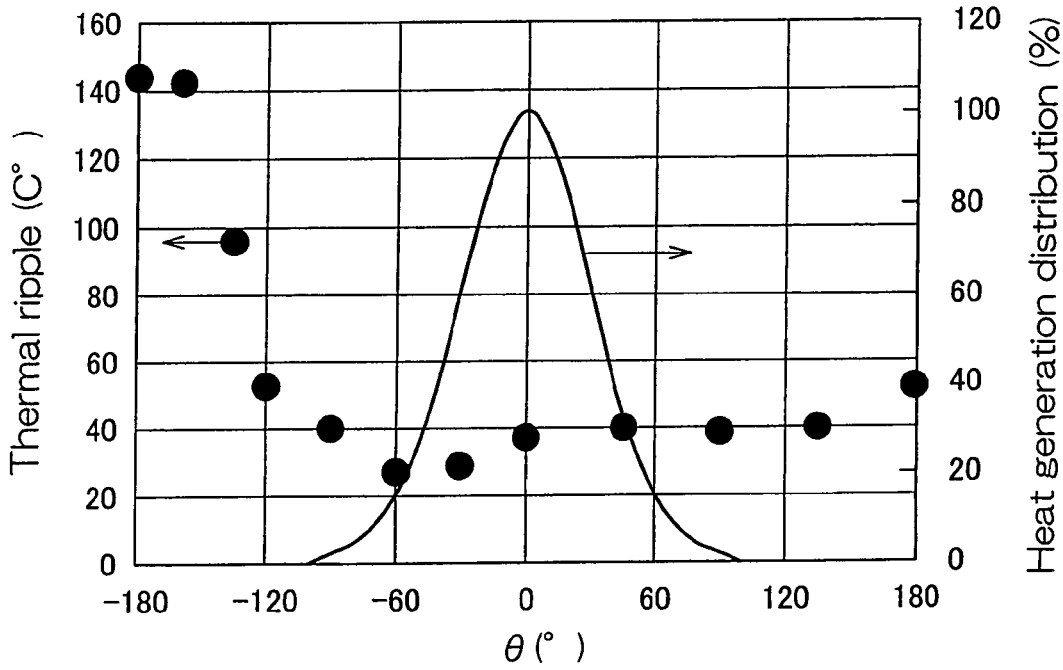
FIG. 10 is a graph showing relationship between temperature sensor location as well as timing correction location and thermal ripple in a fuser apparatus utilizing a heating apparatus associated with the first working example.

From FIG. 10, it can be seen that setting timing correction so as to cause this to be any arbitrary location within the heat generation region ($-90° \leqq \theta \leqq +90°$) of inductive heating means 33 permits stable temperature control, with thermal ripple being held to not more than 40° C. Moreover, within the heat generation region, it was found that there was greater reduction of thermal ripple to the upstream side ($-90° \leqq \theta \leqq 0°$) of the heat generation peak location ($\theta=0°$), for which reason this was found to be preferred.

Furthermore, where fuser apparatus warmup time is as large as, for example, 30 seconds or more, it will be necessary to preheat the fuser apparatus in order to allow immediate return to an operative state from a state in which the image forming apparatus is in standby.

In order to reduce electrical power consumption during preheating to the greatest extent possible, preheating is ordinarily carried out without causing hot roller 31 to rotate; however, unless thermistor 35, which serves as temperature sensor, is installed within the heating region of inductive heating means 33, it will not be possible to carry out temperature control with respect to hot roller 31 during such preheating.

Where fuser apparatus specifications make it necessary to carry out preheating, the following might be done:

(1-1) Install thermistor at location satisfying both the condition that it be within the heating region of the heating means and the condition that it be located so as to cause temperature detection location P2 and heating location P3 to coincide in terms of control timing. Or, where both conditions at (1-1) cannot simultaneously be met, the following might be done:

(2-1) With thermistor within the heating region of the heating means, carry out timing correction so as to cause temperature detection location P2 and heating location P3 to coincide in terms of control timing.

By satisfying either of these conditions (1-1) and (2-1), it will be possible to carry out temperature control during preheating.

Moreover, instead of determining respective values for and summing together the three factors as indicated at Formula (1), above, an actual control system might be used, in which case the three factors might be measured together as a single total control delay time tc [s].

More specifically, this might be determined by instantaneously changing to 180° C. the temperature to which the detection surface of the thermistor is maintained from a state in which same had been maintained at, for example, 160° C. (in which state the output signal to the excitation circuit would have been OFF) and so causing the output signal from control means 36 to excitation circuit 34 to be switched ON, and measuring the interval between the time at which the thermistor detection surface temperature to be maintained was instantaneously changed to the time it takes for the output of excitation circuit 34 to actually reach prescribed electrical power (here, 1200 W).

SECOND WORKING EXAMPLE

Next, a fuser apparatus utilizing a heating apparatus associated with a second working example of the present invention will be described in detail.

Figure 11:
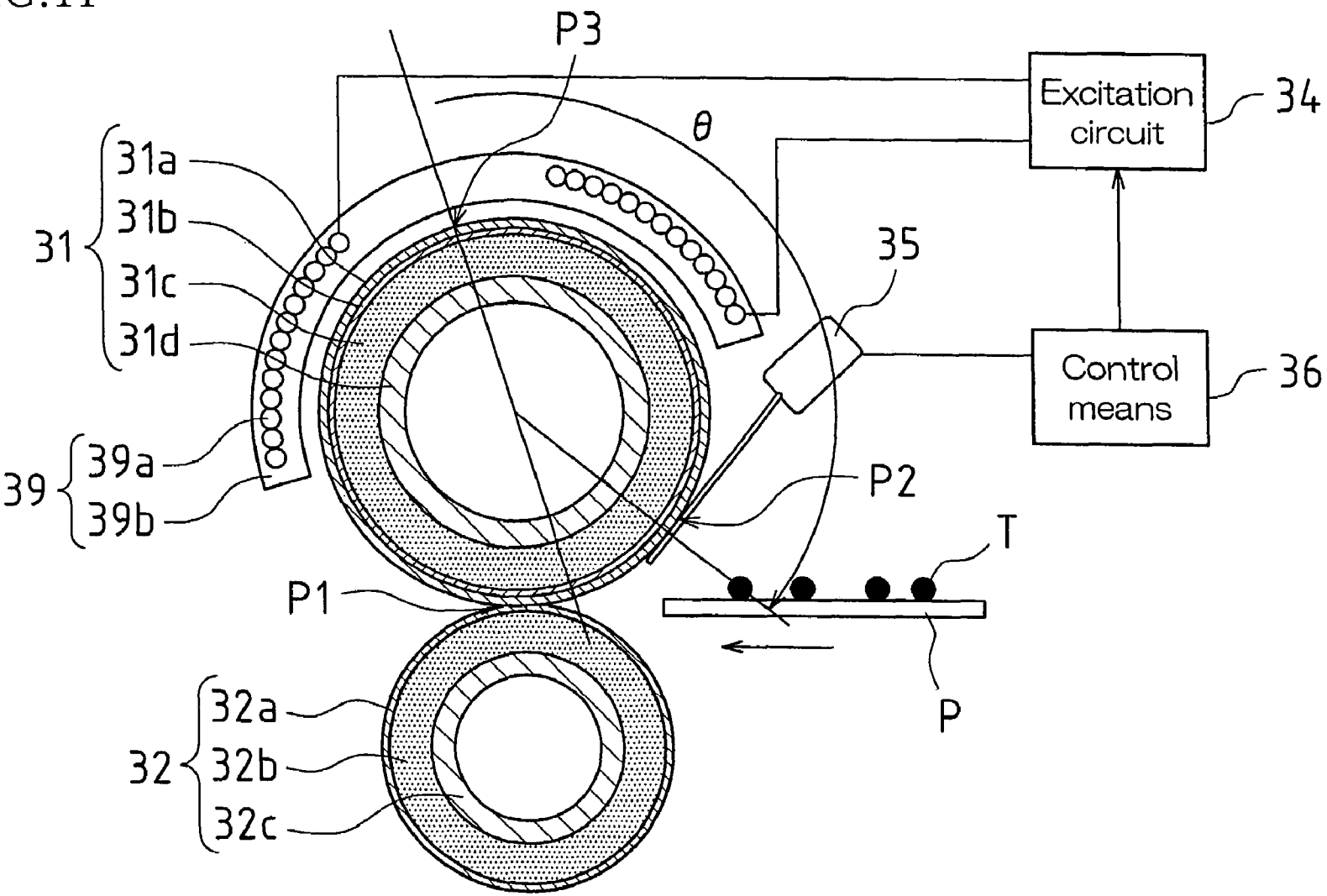
FIG. 11 is a schematic diagram showing constitution of a fuser apparatus utilizing a heating apparatus associated with a second working example of the present invention.

FIG. 11 is a schematic diagram of a fuser apparatus utilizing a heating apparatus associated with the present second working example. Note that, except for inductive heating means 39, the constitution of the fuser apparatus of the present second working example is in other respects completely identical to that of the fuser apparatus of the first working example, and so like components are here assigned like reference numerals and detailed description thereof will be omitted.

As shown in FIG. 11, inductive heating means 39 is made up of inductive coil 39*a* and holder 39*b* which is made from resin and which is for retaining inductive coil 39*a*; inductive heating means 39 being arranged as if to surround the outside circumferential portion of hot roller 31. Because such constitution results in presence of curvature, magnetic flux is concentrated toward the center of inductive coil 39*a*, increasing occurrence of eddy currents, and so this is favorable for causing rapid rise in the surface temperature of hot roller 31.

As material for inductive coil 39*a*, while solid aluminum wire (having an insulating surface layer; e.g., oxide film) is used in the present second working example due to heat resistance considerations, it is also possible to use copper wire or wire made from copper-based composite material, or litz wire (stranded wire in which the strands are made up of enameled wire or the like). Regardless of which wire material is used, to suppress joule losses due to the coil, total resistance of the inductive coil should be not more than 0.5Ω, and preferably not more than 0.1Ω. Furthermore, a plurality of inductive coils 39*a* may be arranged in correspondence to sizes of recording paper to be subjected to fusing.

The alternating magnetic field produced when excitation circuit 34 shown in FIG. 11 causes high-frequency current to flow in this inductive coil 39*a* causes inductive heating of hot roller 31. Disposed in the vicinity of the entrance side of the nip is thermistor 35, control means 36 made up of a CPU (central processing unit) or the like, not shown, controlling excitation circuit 34 in correspondence to a detection signal from thermistor 35, as a result of which the temperature of hot roller 31 is controlled so as to be constant.

During fusing operations employing a fuser apparatus constituted as described above, hot roller 31 is rotated by drive means and heating is carried out by inductive heating means 39, increasing the temperature of the surface of hot roller 31 to a constant temperature (170° C. in the present working example). After the surface of hot roller 31 has reached constant temperature, recording paper P, having unfused toner image T thereon, is fed through nip P1, heat and pressure causing this toner image T to be fused onto recording paper P. When feeding of recording paper P therethrough is completed, heating by inductive heating means 39 is stopped, completing fusing operations.

Description of Method of Controlling Temperature in Fuser Apparatus Utilizing Heating Apparatus Associated with Present Second Working Example Next, referring to FIGS. 11 through 14, a temperature control method for a fuser apparatus utilizing a heating apparatus associated with the present second working example is described.

Figure 12:
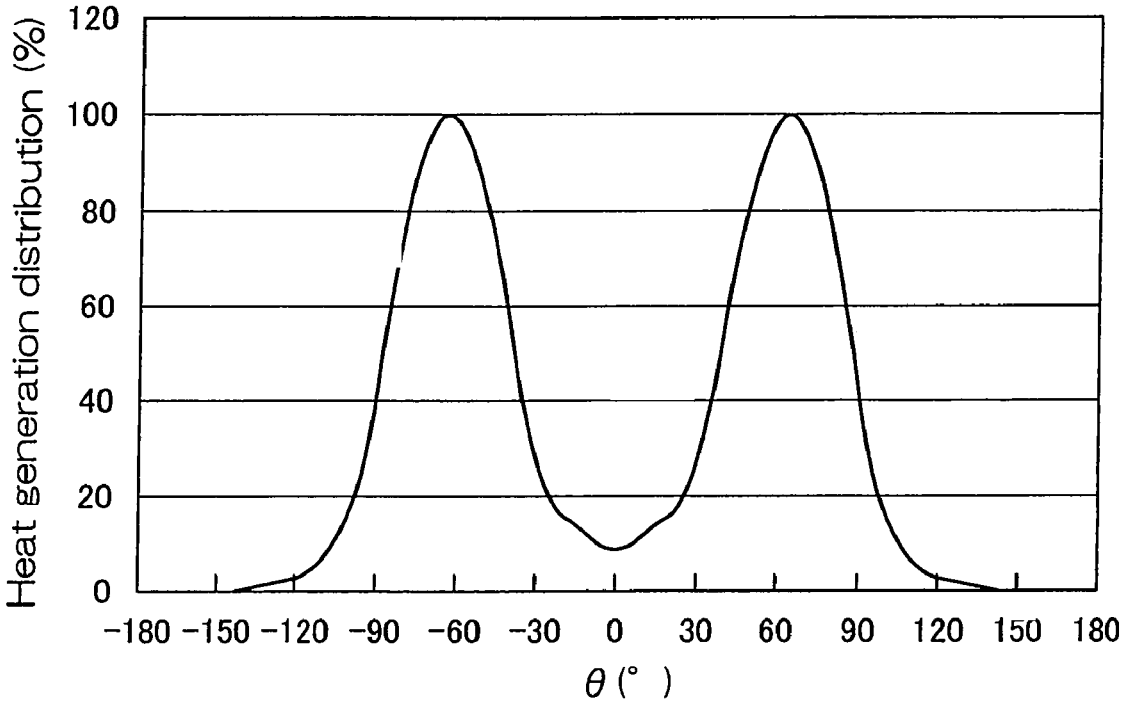
FIG. 12 is a graph showing heat generation distribution of the heating means in the circumferential direction in a fuser apparatus utilizing a heating apparatus associated with the second working example.

Separate analysis of the magnetic field and experimental verification were carried out with respect to heat generation distribution characteristics of inductive coil 39*a* of the present second working example in the circumferential direction of hot roller 31. Results are shown in FIG. 12. Because, as shown in FIG. 12, it was learned that characteristics were such that peaks were present at two locations, these heat generation distribution characteristics were used to carry out two-dimensional thermal conduction simulation(s) as was the case at the first working example.

Figure 13:
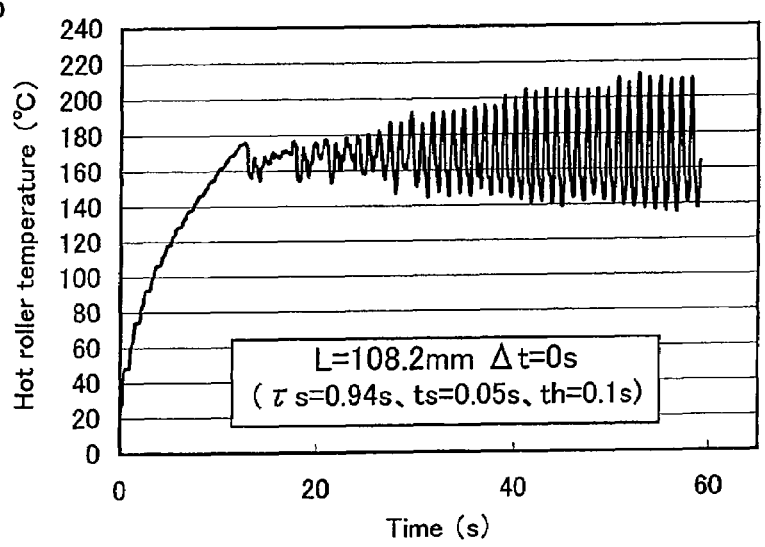
FIGS. 13A, B, C are graphs comparing thermal ripple in a fuser apparatus utilizing a heating apparatus associated with the second working example to a conventional example.
Figure 13:
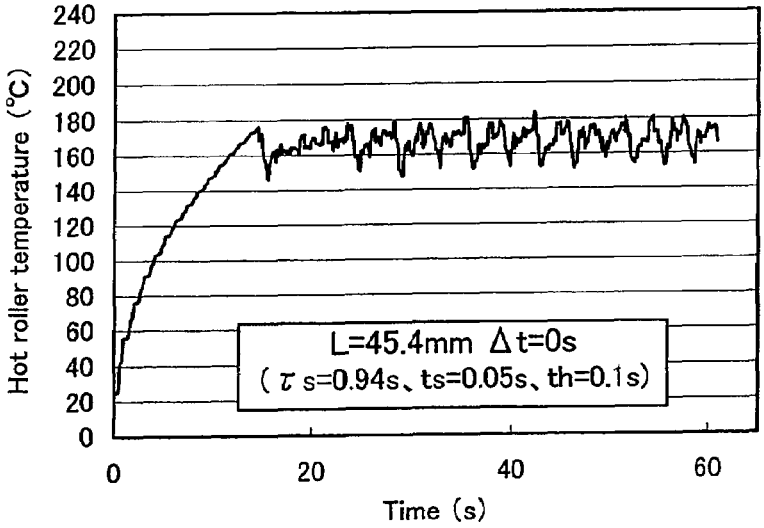
Figure 13:
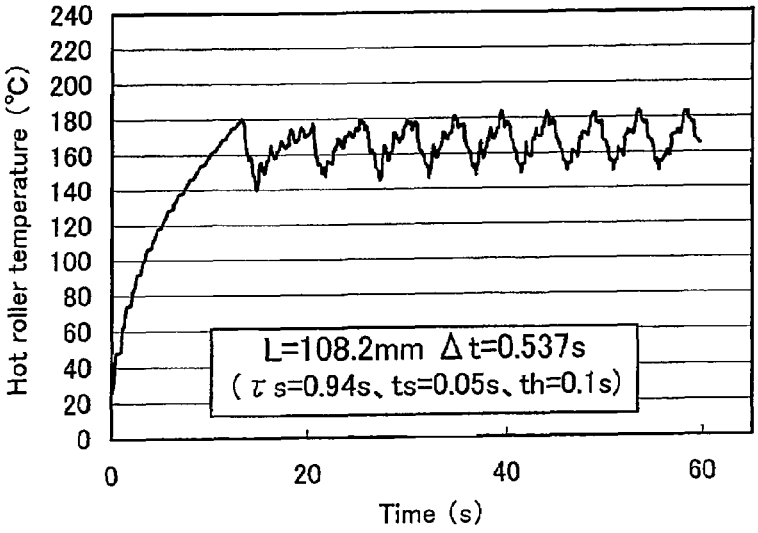

FIG. 13 shows results of using two-dimensional thermal conduction simulation to verify thermal-ripple-reducing effect at hot roller 31 in the second working example for, as was the case at the foregoing first working example, embodiments respectively corresponding to claim 7 and claim 3 of the present application (i.e., (1) locating the temperature sensor at $L=v\cdot tc$; (2) retarding heating timing by $\Delta t \cong L/v-tc$).

In the present second working example, because $v=117$ mm/s, $\tau s=0.94$ s, $ts=0.05$ s, and $th=0.1$ s, Formula (7) gives:

$$tc=0.388 \text{ [s]}$$

Formula (8) can therefore be used to obtain:

$$L=117\times 0.388=45.4 \text{ [mm]}$$

Accordingly, to use the location of the temperature sensor to stabilize temperature control, the temperature sensor should be installed at L=45.4 mm.

Furthermore, if the temperature sensor is installed allocation L=108.2 mm, because Formula (9) gives $$\Delta t=108.2/117-0.388=0.537 \text{ [s]},$$

control timing should be offset by an amount $\Delta t=0.537$ second.

FIG. 13A indicates the situation when temperature sensor location L=108.2 mm and $\Delta t=0$ (i.e., there is no correction of control timing; hereinafter "Comparative Example"); FIG. 13B indicates optimal temperature sensor location (L=45.4 mm; hereinafter "Preferred Working Example (1)"); and FIG. 13C indicates the situation when correction of control timing is carried out (L=108.2 mm and $\Delta t=0.537$ s; hereinafter "Preferred Working Example (2)")—results in all cases being calculated for hot roller temperature when 20 sheets of recording paper are continuously fed through a fuser apparatus following warmup thereof.

From these computational results, it can be seen that while hot roller temperature diverges in the Comparative Example; temperature control stabilizes in Preferred Working Examples (1) and (2) in which temperature sensor location and control timing are optimized, with thermal ripple being under control at not more than 30° C. Note that these computational results have been separately confirmed to agree with experimental results.

Studies were then carried out with respect to where the optimal location should be for heating location P3 of the heating means in similar fashion as was done for the studies at the foregoing first working example.

Heating location P3 of the heating means was in studies performed up to this point tentatively defined to be the location of the center of the heat generation region of the heating means as shown in FIG. 12, with studies being carried out so as to cause correction of timing or correction of the location of temperature sensor 35 to produce agreement relative to this central location; but because, as shown in FIG. 12, the distribution of heat generated by the heating means has a finite width (heat generation region), it is necessary to study which location within the heat generation region would most optimally be defined as heating location P3 when carrying out correction of timing and correction of location of temperature sensor 35.

By using two-dimensional thermal conduction simulation to calculate thermal ripple while varying timing correction time $\Delta t$ with the location of temperature sensor 35 held constant at −180° from the location of the center of the heat generation region of the heating means, studies were therefore carried out to see which location within the heating region is best used in determining timing correction. Results are shown in FIG. 14.

Figure 14:
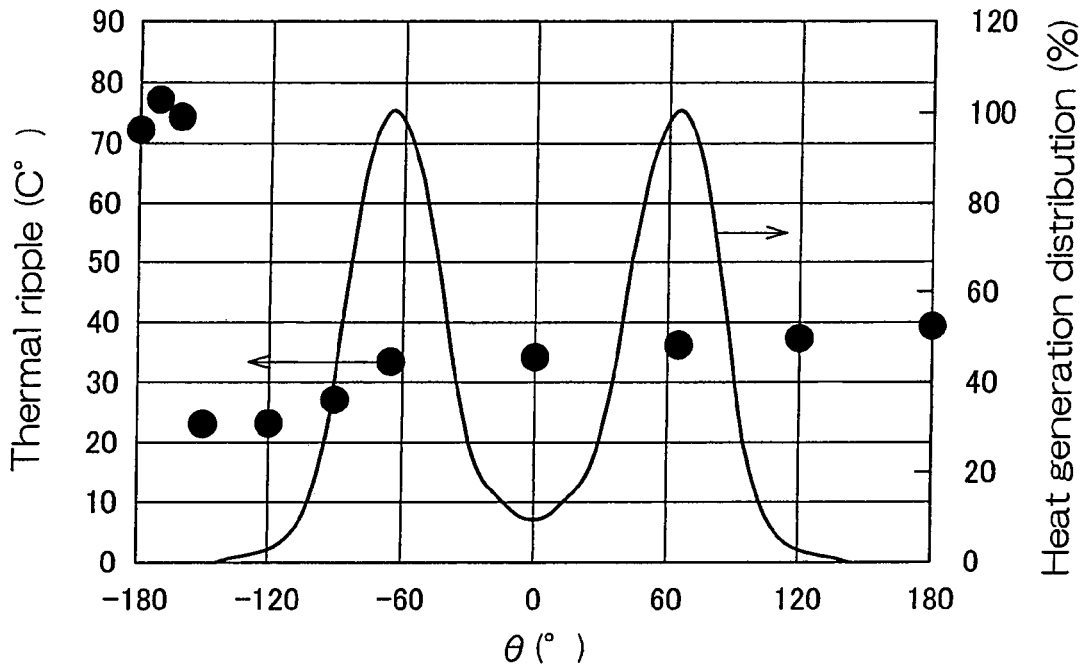
FIG. 14 is a graph showing relationship between temperature sensor location as well as timing correction location and thermal ripple in a fuser apparatus utilizing a heating apparatus associated with the second working example.

From FIG. 14, it can be seen that setting timing correction so as to cause this to be any arbitrary location within the heat generation region ($-135° \leqq \theta \leqq +135°$) of the heating means permits stable temperature control, with thermal ripple being held to not more than 40° C. Moreover, within the heat generation region, it was found that there was greater reduction of thermal ripple to the upstream side ($-135 \leqq \theta \leqq -65°$) of the upstream heat generation peak location ($\theta=-65°$), for which reason this was found to be preferred.

Moreover, whereas the foregoing first and second working examples have each been described in terms of a fuser apparatus in which an inductive heating coil serving as heating means is disposed at the exterior of a hot roller, the present invention is not limited to fuser apparatuses having such constitution; as it goes without saying that the present invention can be applied to good effect, for example, where belt-like component(s) is/are employed as hot member(s), where inductive heating coil(s) is/are disposed at interior(s) of hot member(s), where infrared light from halogen heater(s) disposed at exterior(s) of hot member(s) is reflected toward hot member(s) by reflector(s) so as to cause heating in local fashion, and in other such fuser apparatuses constituted such that local heating of hot member(s) takes place.

Moreover, the present invention may be embodied in a wide variety of forms other than those presented herein without departing from the spirit or essential characteristics thereof. The foregoing embodiments, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A heating apparatus comprising:

one or more revolving hot members;

one or more heating means for heating at least one zonal portion in at least one direction of revolution of at least one of the hot member or members;

one or more temperature detection means for detecting at least one temperature of at least one of the heating means; and one or more temperature control means for controlling at least one output of at least one of the heating means based on temperature detection data from at least one of the temperature detection means; wherein taking at least one circumferential speed of at least one of the hot member or members to be v [mm/s]; and taking at least one temperature control delay time of at least one of the temperature control means to be tc [s];

at least one of the temperature detection means is installed L [mm] upstream in at least one direction of revolution of at least one of the hot member or members from at least one heating location of at least one of the heating means; where $$L=v\cdot tc.$$

2. A heating apparatus according to claim 1 wherein:

taking at least one at least one thermal time constant of at least one of the temperature detection means to be τs [s];

taking at least one cyclical sampling period of at least one of the temperature detection means and/or at least one cyclical control period of at least one of the temperature control means to be ts [s]; and taking at least one rise time of at least one of the heating means to be th [s];

at least one of the temperature control delay time or times tc [s] of at least one of the temperature control means satisfies the equation:

$$tc=(31.6/v)\cdot(1-e(-\tau s/0.00214v))+0.5ts+th.$$

3. A heating apparatus according to claim 1 wherein at least one of the heating location or locations of at least one of the heating means is defined to be at least one heat generation subregion upstream in at least one direction of rotation of at least one of the hot member or members from at least one location at which at least one amount of heat generated by at least one of the heating means is initially a maximum.

4. A heating apparatus according to any of claims 1 through 3 wherein at least one of the temperature detection means is disposed within at least one heating region of at least one of the heating means.

5. A heating apparatus according to any of claims 1 through 3 wherein at least one of the heating means comprises one or more inductive heating means.

6. A heating apparatus according to claim 4 wherein at least one of the heating means comprises one or more inductive heating means.

7. A heating apparatus according to claim 5 wherein one or more inductive heating coils of at least one of the inductive heating means is or are disposed at the exterior of at least one of the hot member or members.

8. A heating apparatus according to claim 6 wherein one or more inductive heating coils of at least one of the inductive heating means is or are disposed at the exterior of at least one of the hot member or members.

9. An image forming apparatus comprising at least one of the heating apparatus or apparatuses according to claim 1.

* * * * *